US008058804B2

(12) United States Patent
Yoon et al.

(10) Patent No.: US 8,058,804 B2
(45) Date of Patent: Nov. 15, 2011

(54) DISPLAY DEVICE HAVING LIGHT BLOCKING MEMBERS

(75) Inventors: Seok-il Yoon, Daejeon (KR); Jeong-ho Nho, Suwon-si (KR); Sung-hwan Lim, Suwon-si (KR); Wook-jae Jeon, Suwon-si (KR); Dae-hee Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1008 days.

(21) Appl. No.: 11/723,251

(22) Filed: Mar. 19, 2007

(65) Prior Publication Data

US 2007/0290946 A1 Dec. 20, 2007

(30) Foreign Application Priority Data

Jun. 15, 2006 (KR) ..... 10-2006-0053851

(51) Int. Cl.
*H01J 17/49* (2006.01)
*H01J 17/26* (2006.01)

(52) U.S. Cl. ..... 313/582; 313/581; 313/567; 313/583; 313/584; 313/112

(58) Field of Classification Search ..... None
See application file for complete search history.

(56) References Cited

U.S. PATENT DOCUMENTS

| | | | | |
|---|---|---|---|---|
| 5,911,616 | A | 6/1999 | Levine et al. | |
| 5,939,826 | A * | 8/1999 | Ohsawa et al. | 313/582 |
| 6,636,355 | B2 | 10/2003 | Moshrefzadeh et al. | |
| 7,218,043 | B2 * | 5/2007 | Hong et al. | 313/110 |
| 2002/0080484 | A1 | 6/2002 | Moshrefzadeh et al. | |
| 2004/0263078 | A1 | 12/2004 | Woo et al. | |
| 2005/0152032 | A1 * | 7/2005 | Olofson et al. | 359/453 |
| 2005/0236949 | A1 * | 10/2005 | Hong et al. | 313/110 |
| 2006/0125366 | A1 * | 6/2006 | Chang | 313/112 |
| 2007/0285790 | A1 * | 12/2007 | Yoon et al. | 359/609 |
| 2009/0009445 | A1 * | 1/2009 | Lee | 345/85 |

FOREIGN PATENT DOCUMENTS

| | | | |
|---|---|---|---|
| CN | 1483156 | A | 3/2004 |
| CN | 1787044 | A | 6/2006 |
| EP | 1670024 | A2 | 12/2005 |
| WO | 03/042726 | A1 | 5/2003 |
| WO | 2005/104167 | A1 | 11/2005 |

OTHER PUBLICATIONS

Office Action dated May 12, 2010 issued by the State Intellectual Property Office in P.R. China in Chinese counterpart application No. 200710005557.4.

* cited by examiner

*Primary Examiner* — Natalie Walford
(74) *Attorney, Agent, or Firm* — Sughrue Mion, PLLC

(57) ABSTRACT

A display panel includes a plurality of light guides which emit received light, and a plurality of external light blocking members which are disposed between exit surfaces of the plurality of light guides, and block light from the outside. Accordingly, the bright room contrast of the PDP is enhanced.

36 Claims, 8 Drawing Sheets

DISPLAY DEVICE HAVING LIGHT BLOCKING MEMBERS

CROSS-REFERENCE TO RELATED APPLICATIONS

This application claims the benefit under 35 U.S.C. §119 (a) of Korean Patent Application No. 10-2006-0053851, filed on Jun. 15, 2006, in the Korean Intellectual Property Office, the entire disclosure of which is hereby incorporated by reference.

BACKGROUND OF THE INVENTION

1. Field of the Invention

The present invention relates to a display panel, and more particularly, to an advanced display panel which displays images using a plasma type of display.

2. Description of the Related Art

In general, display panels of a plasma method, which are called plasma display panels (PDP), display images using electric discharge. PDPs are widely popular due to their display performance, including superior luminance visual angle and other features.

PDPs are divided into a facing discharge type and a surface discharge type, depending on the location structure of the electrodes. Facing discharge type PDPs have a pair of sustaining electrodes which is disposed on an upper substrate and a lower substrate, and form an electric discharge in a direction perpendicular to the panel. Surface discharge type PDPs have a pair of sustaining electrodes which is disposed on the same substrate, and generates an electric discharge on one surface.

Facing discharge type PDPs have a high luminous efficacy, but suffer from the problem that phosphor is easily degraded by the electric discharge, thus, recently surface discharge type PDPs have become more widely used.

FIG. 1 shows the structure of a conventional PDP. The PDP in FIG. 1 is a surface discharge type PDP. In order to show the internal structure of the PDP more easily, the PDP is partially incised and an upper substrate 20 is rotated at a 90° angle.

A plurality of address electrodes 11 are disposed on the lower substrate 10 in a striped pattern and are buried by a first dielectric layer 12, which is white. A plurality of dams 13 are formed on the first dielectric layer 12 at predetermined intervals in order to prevent electrical and optical cross-talk between discharge cells 15. The insides of the discharge cells 15, which are partitioned by the plurality of dams 13, are coated with a phosphor layer 14 and are filled with discharge gas for plasma discharge. The discharge gas is a mixture of neon (Ne), Xenon (Xe) and other gases.

The upper substrate 20 is a transparent substrate through which visible light can penetrate, is made mainly of glass, and is sealed on the lower substrate 10 with the dams 13. Sustaining electrodes 21*a* and 21*b* are disposed in pairs under the upper substrate 20 and are perpendicular to the address electrodes 11. The sustaining electrodes 21*a* and 21*b* are made of transparent conductive material such as Indium Tin Oxide (ITO). To reduce line resistance of the sustaining electrodes 21*a* and 21*b*, bus electrodes 22*a* and 22*b* composed of metal are disposed under the sustaining electrodes 21*a* and 21*b* and have a narrower width than the sustaining electrodes 21*a* and 21*b*. The sustaining electrodes 21*a* and 21*b* and the bus electrodes 22*a* and 22*b* are buried by a second dielectric layer 23, which is transparent. A protection layer 24 is disposed under the second dielectric layer 23. The protection layer 24 prevents damage to the second dielectric layer 23 caused by sputtering of plasma particles, emits secondary electrons so as to lower discharge voltage and sustaining voltage, and is generally composed of magnesium oxide (MgO).

A plurality of black stripes 30 are disposed on the upper substrate 20 at predetermined intervals parallel to the sustaining electrodes 21*a* and 21*b* so as to prevent external light from entering the inside of the panel.

A wall charge is formed by generating an address discharge between one of the sustaining electrodes 21*a* and 21*b* and the address electrode 11, and then sustaining discharge is generated by the electric potential difference between the pair of sustaining electrodes 21*a* and 21*b*, so ultraviolet rays are generated by the discharge gas. The phosphor layer 14 is excited by the ultraviolet rays, causing visible light to be emitted. The visible light exits the upper substrate 20 and forms images which are perceptible to the user.

In such conventional PDPs, if the surroundings are brightly lit, for example, in a bright room, external light enters the discharge cells 15 or is reflected from the upper substrate 20 so that bright room contrast is reduced. Consequently, the image displaying performance of the PDP deteriorates.

SUMMARY OF THE INVENTION

Exemplary embodiments of the present invention address at least the above problems and/or disadvantages and provide at least the advantages described below. Accordingly, an apparatus consistent with the present invention provides a PDP having an upper substrate of an improved structure so as to enhance the bright room contrast of the PDP.

Another apparatus consistent with the present invention provides a PDP employing a filter with an improved structure so as to enhance the bright room contrast of the PDP.

The foregoing and other objects and advantages are substantially realized by providing an exemplary display panel comprising: a plurality of light guides which emit received light; and a plurality of external light blocking members which are disposed between exit surfaces of the plurality of light guides, and block light from the outside.

In an exemplary embodiment, spaces are formed between the plurality of light guides. The spaces are formed under the plurality of external light blocking members. The space is filled with gaseous material.

In an exemplary embodiment, the external light blocking member is composed of carbon black of maximum density.

In an exemplary embodiment, the light guide has an exit surface which is wider than the incidence surface through which light enters.

In an exemplary embodiment, the display panel further comprises an electromagnetic interface (EMI) prevention layer which is formed as a mesh or as a conductive film and prevents EMI; an antireflection layer which is formed as an anti-reflective (AR) film and prevents external light from being reflected; and a near infrared blocking layer which blocks near infrared rays included in light rays passing through the light guide.

Meanwhile, the foregoing and other exemplary objects and advantages may be substantially realized by providing a plasma display panel (PDP), comprising: a lower substrate and an upper substrate which are separated to form a plurality of discharge cells therebetween, wherein the upper substrate comprises a plurality of light guides which focus and emit light generated from the plurality of discharge cells; and a plurality of external light blocking members which are disposed between exit surfaces of the plurality of light guides, and block light from the outside.

In an exemplary embodiment, spaces are formed on the upper substrate by being surrounded by the plurality of light guides and the plurality of external light blocking members. The space is filled with gaseous material. The gaseous material is air.

In an exemplary embodiment, the PDP further comprises a plurality of address electrodes which are disposed on the lower substrate in a striped pattern and generate a wall charge in the discharge cells.

In an exemplary embodiment, the plurality of light guides are parallel to the plurality of address electrodes, or perpendicular to the plurality of address electrodes.

Meanwhile, the foregoing and other exemplary objects and advantages may be substantially realized by providing a filter which filters screen output of a display device, the filter comprising: a plurality of light guides which emit received light; and a plurality of external light blocking members which are disposed between exit surfaces of the plurality of light guides, and block light from the outside.

In the exemplary embodiment, spaces may be formed between the plurality of light guides. The spaces are formed under the plurality of external light blocking members. The space is filled with gaseous material. The gaseous material is air.

In the exemplary embodiment, the external light blocking member may be composed of carbon black of maximum density. The light guide has an exit surface wider than the incidence surface through which light enters.

In an exemplary embodiment, the display device is a PDP.

Meanwhile, the foregoing and other exemplary objects and advantages may be substantially realized by providing a filter, comprising: a plurality of light guides which are bonded on a display panel, and focus, and emit light generated from the display panel; and a plurality of external light blocking members which are disposed between exit surfaces of the plurality of light guides, and block light from the outside, wherein air layers are formed between the plurality of light guides and the plurality of external light blocking members.

BRIEF DESCRIPTION OF THE DRAWINGS

The above aspects and features of the present invention will be more apparent by describing certain exemplary embodiments of the present invention with reference to the accompanying drawings, in which.

Throughout the drawings, the same drawing reference numerals will be understood to refer to the same elements, features, and structures.

DETAILED DESCRIPTION OF EXEMPLARY EMBODIMENTS OF THE PRESENT INVENTION

The matters defined in the description such as the detailed description of the construction and elements are provided to assist in a comprehensive understanding of the embodiments of the invention and are merely exemplary. Accordingly, those with ordinary skill in the art will recognize that various changes and modifications of the embodiments described herein can be made without departing from the scope and spirit of the invention. Also, descriptions of well-known functions and constructions are omitted for clarity and conciseness.

Figure 2:
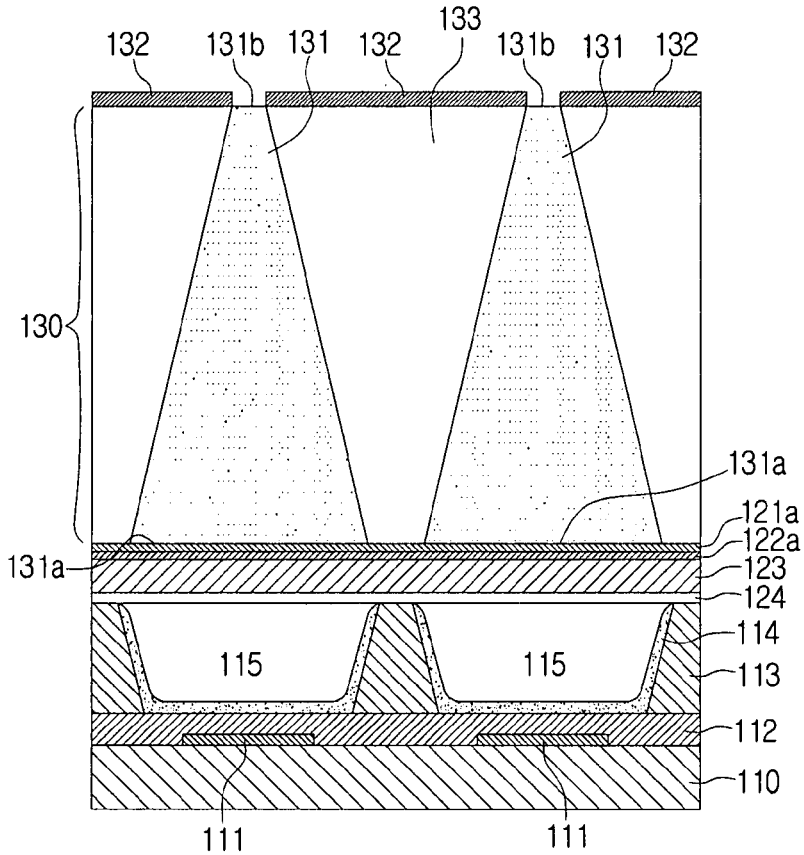
FIG. 2 shows the structure of a PDP according to an exemplary embodiment of the present invention.

FIG. 2 shows the structure of a PDP according to an exemplary embodiment of the present invention.

The plasma display panel (PDP) in FIG. 2 according to an exemplary embodiment of the present invention comprises an upper substrate 130 and a lower substrate 110 which are separated from each other. A plurality of discharge cells 115 are formed between the upper substrate 130 and the lower substrate 110 and cause plasma discharge.

The lower substrate 110 is a glass substrate and has a plurality of address electrodes 111 arranged in a striped pattern thereon for address discharge. A first dielectric layer 112 is disposed on the lower substrate 110 to cover the address electrodes 111 and is formed by applying a predetermined thickness of dielectric material, which is white, on the lower substrate 110.

A plurality of dams 113 are disposed on the first dielectric layer 112 at predetermined intervals parallel to the address electrodes 111. The plurality of dams 113 form discharge cells 115 by partitioning space between the lower substrate 110 and the upper substrate 130, and prevent electrical and optical cross-talk between discharge cells 115 to enhance color purity. A phosphor layer 114 of red, green and blue colors is applied on the first dielectric layer 112 and both sides of the dams 113, which constitute the inner wall of the discharge cell 115, at a predetermined thickness. The inside of the discharge cell 115 is filled with discharge gas which is a mixture of neon (Ne), generally used for plasma discharge, and a small amount of Xenon (Xe). The phosphor layer 114 is excited by ultraviolet rays generated by plasma discharge of the discharge gas, and emits visible light corresponding to the phosphor layer 114 of each color.

The upper substrate 130 comprises light guides 131 which focus and emit ultraviolet rays generated by discharge. The light guides 131 are disposed parallel to the address electrodes 111. An external light blocking member 132 is disposed between exit surfaces 131*b* of the light guides 131 to block light from the outside to the discharge cell 115.

A space 133, which is surrounded by the light guides 131 and the external light blocking member 132, is formed on the upper substrate 130 and is filled with gases such as air. The external light blocking member 132 is composed of carbon black of maximum density and absorbs light from the outside, so that it can prevent contrast from being lowered by external light. The external light blocking member 132 may comprise a conductive film (not shown) for blocking electro-magnetic interference (EMI).

The light guides 131 can be configured so that one light guide 131 corresponds to one discharge cell 115 as shown in FIG. 2, or can be configured so that one light guide 131 corresponds to several discharge cells 115. In the light guide 131, an incidence surface 131*a* thereof is wider than the exit surface 131*b*, so visible light generated from the discharge cell 115 is received through the incidence surface 131*a* and focused so as to exit through the exit surface 131*b*.

As the light guide 131 can be produced in a width of scores of μm, it can be used to implement high precision images to enhance the luminance of a panel. Moreover, the exit surfaces 131*b* of the light guides 131 are processed with non-glare treatment, so it can prevent glare caused by reflecting external light from the exit surface 131*b* of the light guide 131.

A discharge electrode 121*a* is disposed under the upper substrate 130 for sustaining discharge and is perpendicular to the address electrode 111. The discharge electrodes 121*a* are disposed in pairs in the same manner as the electrodes in FIG. 1, but the upper substrate 130 of FIG. 2 is not rotated to 90°, so just one discharge electrode 121*a* is illustrated in FIG. 2. The discharge electrode 121*a* is composed of mainly transparent conductive material such as indium tin oxide (ITO) so that visible light generated from the discharge cell 115 may pass through. A bus electrode 122*a* is disposed under the discharge electrode 121*a* and is composed of metal. The bus electrodes 122*a* are disposed in pairs in the same manner as the discharge electrodes 121*a*. The bus electrode 122*a* reduces line resistance of the discharge electrodes 121*a* and has a narrower width than the discharge electrodes 121*a*.

Subsequently, a second dielectric layer 123 is disposed to cover the discharge electrodes 121*a* and the bus electrode 122*a*. The second dielectric layer 123 can be formed by applying a predetermined thickness of transparent dielectric material under the upper substrate 130. A protection layer 124 is disposed under the second dielectric layer 123, prevents damage of the second dielectric layer 123 and the discharge electrodes 121*a* caused by the sputtering of plasma particles, emits secondary electrons so as to lower discharge voltage. The protection layer 124 can be formed by applying a predetermined thickness of magnesium oxide (MgO) under the second dielectric layer 123.

In the above-described PDP, firstly, an address discharge occurs between one of the pair of discharge electrodes 121*a* and 121*b* and the address electrode 111, so a wall charger is generated. Subsequently, if an alternating voltage is supplied to the pair of discharge electrodes 121*a* and 121*b*, sustaining discharge occurs inside the discharge cell 115 where a wall charger has been generated, and ultraviolet rays are generated from the discharge gas. As a result, ultraviolet rays excite the phosphor layer 114 so that visible light is generated.

The visible light is received and focused by the incidence surface 131*a* of the light guide 131 and exits through the exit surface 131*b*. As the interface of the light guide 131 is processed not to cause light scattering, total reflection inside the light guide 131 is maximized. At this time, the external light blocking member 132 prevents external light from entering the discharge cell 115 or reflecting, so that the bright room contrast is enhanced.

Figure 3:
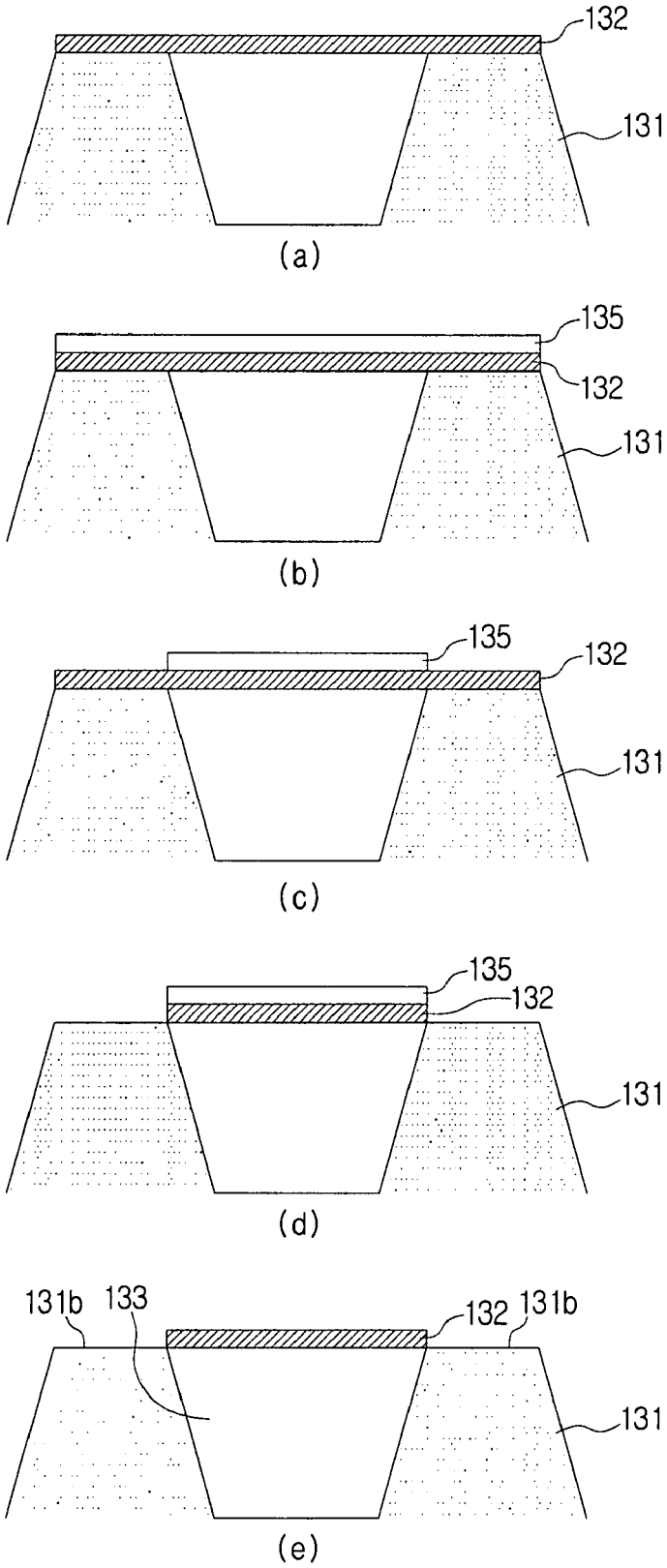
FIGS. 3(*a*)-3(*e*) are drawings describing a process of forming an external light blocking member of a PDP according to an exemplary embodiment of the present invention.

FIGS. 3(*a*)-3(*b*) are drawings describing a process of forming an external light blocking member of a PDP according to an exemplary embodiment of the present invention.

The area of the exit surface 131*b* in FIG. 3 is smaller than that of the incidence surface 131*a*, a bonding agent (not shown) is applied to the exit surface 131*b*, and the external light blocking member 132 is attached thereto (FIG. 3(*a*)). The external light blocking member 132 is made of carbon black of maximum density. Subsequently, a photosensitive material 135 such as photoresist is applied to the external surface of the external light blocking member 132 (FIG. 3(*b*)).

The photosensitive material 135 corresponding to the shape of the external light blocking member 132 is left by being exposed using a photomask (not shown) formed corresponding to the shape of the external light blocking member 132 and by developing the photosensitive material 135 (FIG. 3(*c*)). Next, the shape of the external light blocking member 132 including a certain area for bonding is left by etching the external light blocking member 132 applied on the exit surface 131*b* of the light guide 131 (FIG. 3(*d*)), and then the photosensitive material 135 is stripped (FIG. 3(*e*)).

The external light blocking member 132 is formed between the exit surfaces 131*b* of the light guide 131 according to the aforementioned photolithograph process, and the space 133 is formed between the external light blocking member 132 and the light guides 131.

Figure 4A:
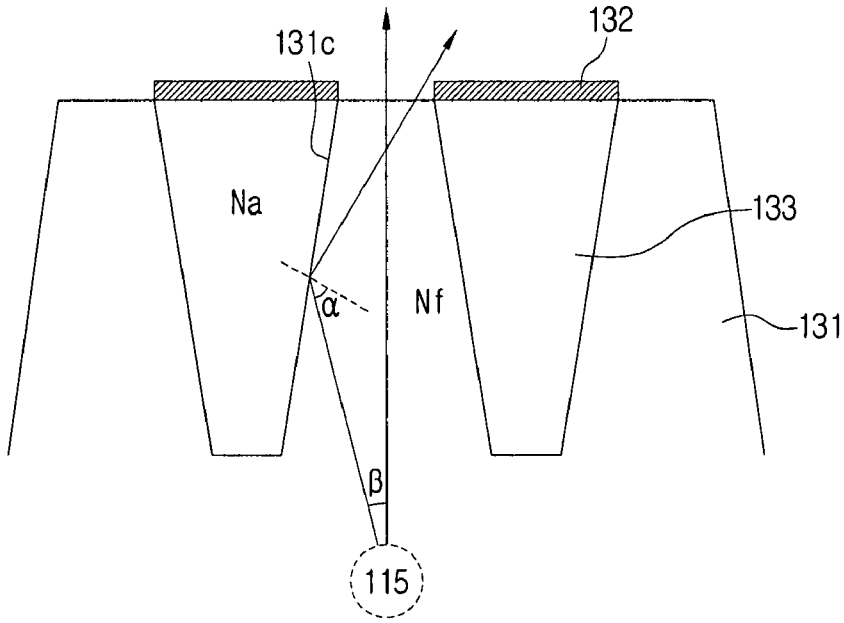
FIGS. 4A and 4B are drawings describing the optical characteristics of a light guide in a PDP according to an exemplary embodiment of the present invention.
Figure 4B:
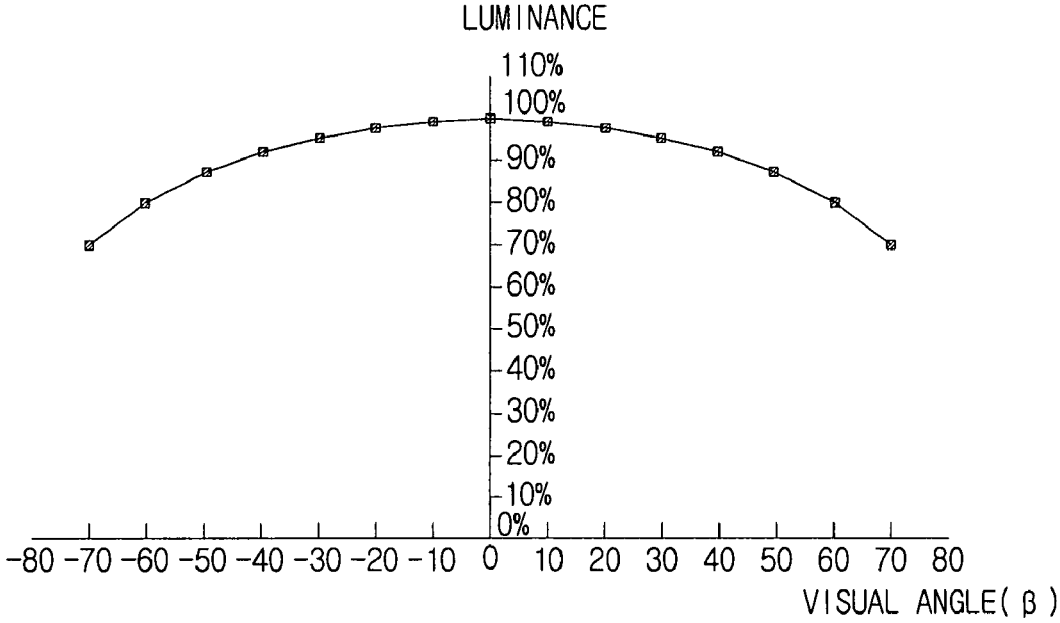

FIGS. 4A and 4B are drawings describing the optical characteristics of a light guide in a PDP according to an exemplary embodiment of the present invention.

In general, when light enters at a certain angle from a high refractive index medium to a low refractive index medium, if the launch angle of the light is higher than a certain critical angle, the light causes total internal reflection on the interface between both media. The light guide 131 focuses and exits visible light generated from the discharge cell 115 using this feature.

Referring to FIG. 4A, when visible light generated from the discharge cell 115 enters an interface 131*c* of the light guide 131 at a certain launch angle α, if the launch angle α is higher than a certain critical angle Θ, total internal reflection occurs in the light guide 131. The critical angle Θ is calculated as follows:

$$\theta=\arcsin(Na/Nf) \quad \text{[Equation 1]}$$

In Equation 1, Na is the refractive index of the medium which fills the space 133, and Nf is the refractive index of the light guide 131. The lower the refractive index of the medium which fills the space 133, the higher the critical angle Θ is obtained.

If the medium which fills the space 133 is a vacuum, the refraction index of the space 133 is 1. In this condition, the light guide 131 meets total internal reflection conditions at maximum. This is because a medium of the minimum total internal reflection is a vacuum. If the space 133 is filled with air, the total internal reflection is 1.00029, so the total internal reflection condition of the light guide 131 is similar to that encountered in a vacuum. That is, a critical angle Θ lower than in any condition where the space 133 is filled with other material, not air, can be obtained. Accordingly, as the critical angle Θ gets lower, total internal reflection occurs well in spite of the low launch angle α.

FIG. 4B is a profile showing the distribution of luminance according to the visual angle β of visible light which has excited from the discharge cell 115. Visible light generated from the discharge cell 115 of the PDP is diffused light, which exits in all directions and distribution of luminance of which varies according to the visual angle β.

Table 1 shows the correlation between the luminance and the launch angle α according to the visual angle β of the diffused light shown in FIG. 4B.

TABLE 1

| Visual angle (°) | Luminance (%) | launch angle (°) |
|---|---|---|
| −70 | 72.7 | 16.73 |
| −60 | 84.0 | 26.73 |
| −50 | 90.4 | 36.73 |

TABLE 1-continued

| Visual angle (°) | Luminance (%) | launch angle (°) |
|---|---|---|
| −40 | 94.4 | 46.73 |
| −30 | 96.7 | 56.73 |
| −20 | 98.5 | 66.73 |
| −10 | 100 | 76.73 |
| 0 | 100 | 86.73 |
| 10 | 100 | 76.73 |
| 20 | 98.5 | 66.73 |
| 30 | 96.7 | 56.73 |
| 40 | 94.4 | 46.73 |
| 50 | 90.4 | 36.73 |
| 60 | 84.0 | 26.73 |
| 70 | 72.7 | 16.73 |

As shown in Table 1, the luminance of the diffused light and launch angle α on the interface 131*c* vary according to the visual angle β. That is, the higher the absolute value of the visual angle β, the lower the luminance of the diffused light and the lower the launch angle α.

Figure 5A:
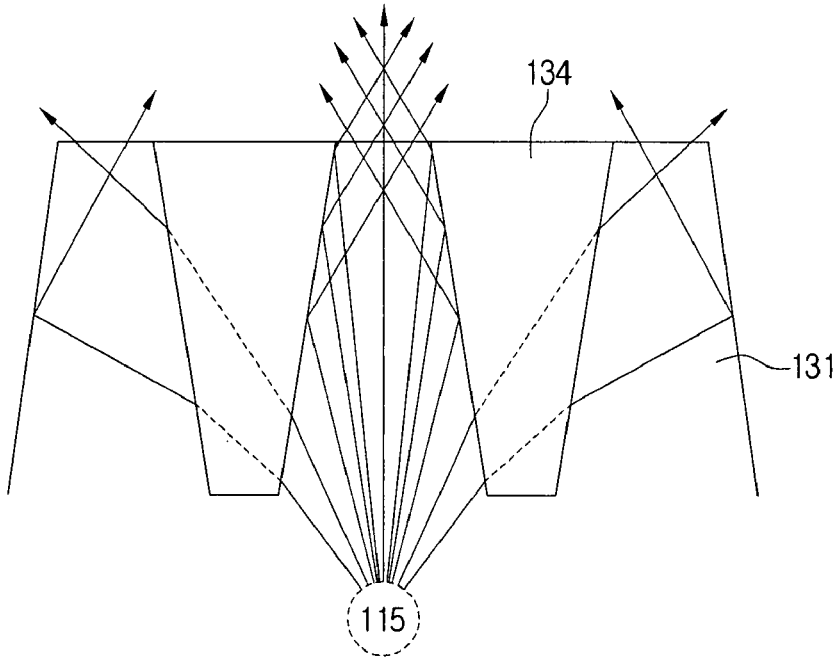
FIGS. 5A and 5B are drawings describing the total internal reflection efficiency of a light guide in a PDP according to an exemplary embodiment of the present invention.
Figure 5B:
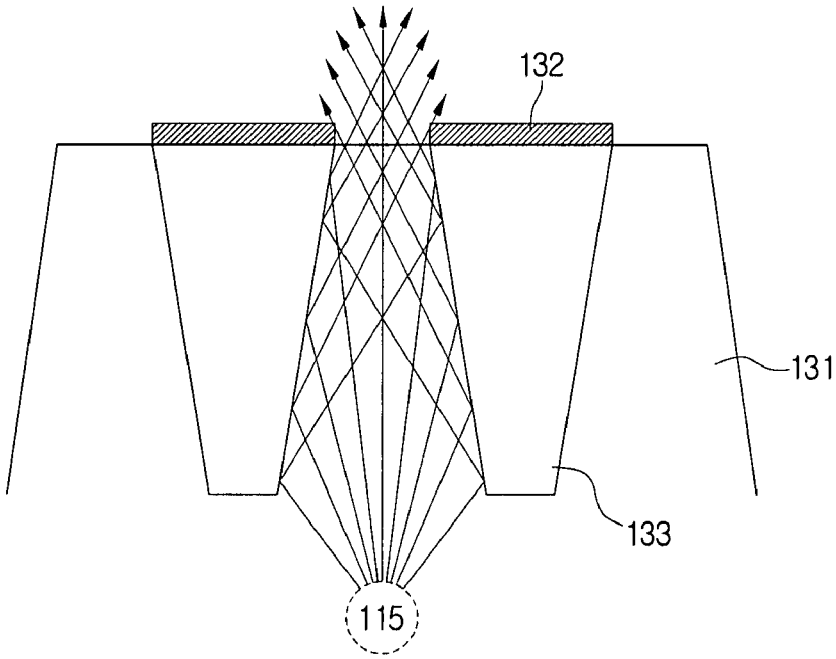

FIGS. 5A and 5B are drawings describing the total internal reflection efficiency of a light guide in a PDP according to an exemplary embodiment of the present invention.

FIG. 5A shows total internal reflection in the light guide 131, when space between the light guides 131 is filled with a low refractive index medium 134. FIG. 5B shows total internal reflection in the light guide 131, when space between the light guides 131 is implemented with the space 133 according to the exemplary embodiment of the present invention.

In FIG. 5A, assuming that the low refractive index medium 134 has a refractive index higher than air and the refractive index of the low refractive index medium 134 is 1.4, the critical angle ⊖ of visible light generated from the discharge cell 115 is calculated at about 63.8° by Equation 1. In FIG. 5B, as the refractive index of an air layer 133 is 1, the critical angle ⊖ of visible light generated from the discharge cell 115 is calculated to about 39.8° by Equation 1.

In other words, in the case of FIG. 5A, light having a launch angle α equal to or higher than 63.8° is totally reflected in the light guide 131 and exits through the exit surface 131*b*. Additionally, light having a launch angle α lower than 63.8° is refracted through the low refractive index medium 134 and exits through the exit surface 131*b*. In contrast, in the case of FIG. 5B, light having a launch angle α equal to or higher than 39.8° is totally reflected in the light guide 131 and exits through the exit surface 131*b*.

Referring to Table 1, in the case of FIG. 5A, diffused light having a visual angle β between about −23°~about +23° meets the condition for total reflection, and, in the case of FIG. 5B, diffused light having a visual angle β between about −45°~about +45° meets the conditions for total reflection. Therefore, if the space 133 is filled with air, high efficiency transmission of diffused light is maintained.

Figure 6:
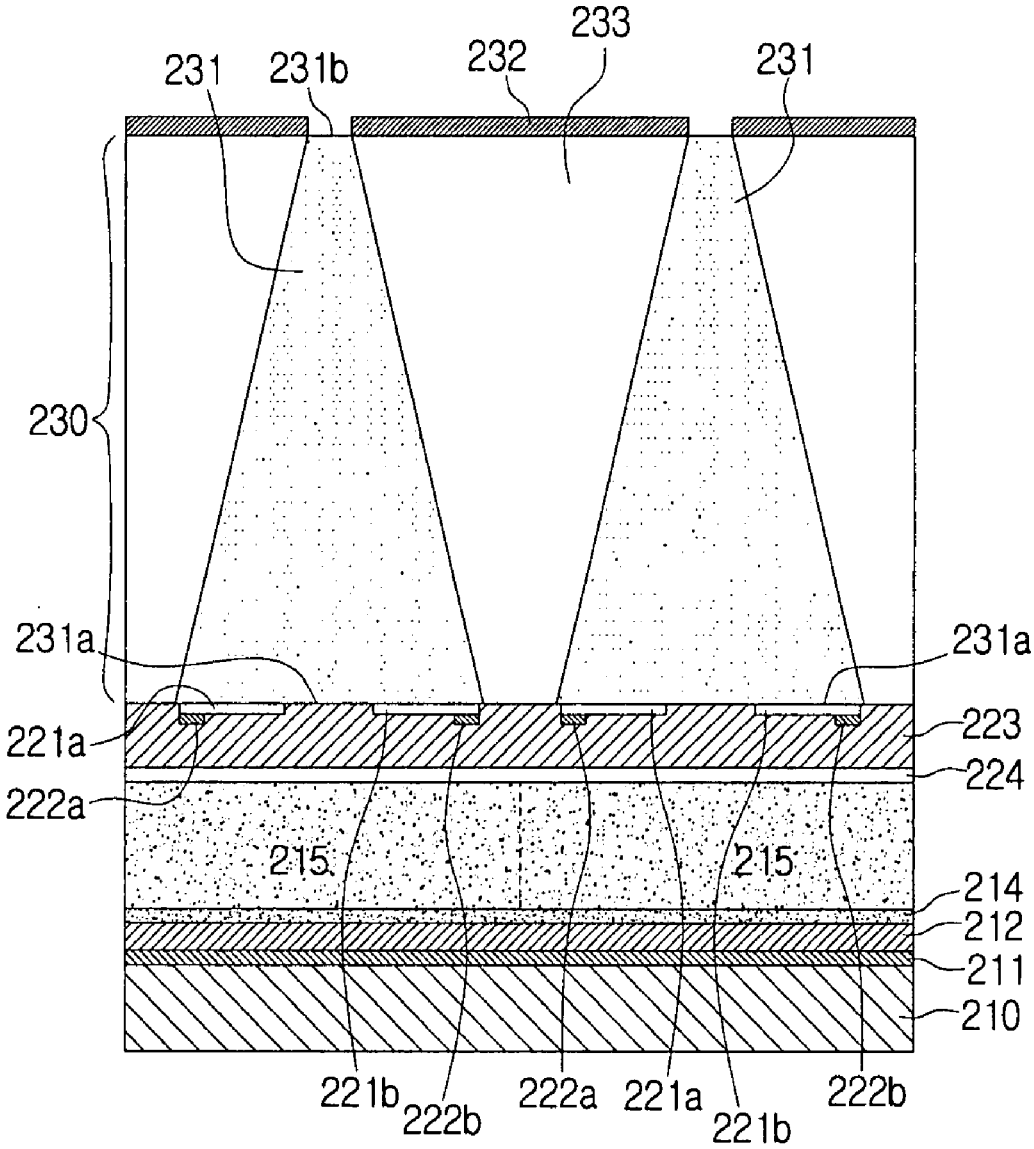
FIG. 6 shows the structure of a PDP according to another exemplary embodiment of the present invention.

FIG. 6 shows the structure of a PDP according to another exemplary embodiment of the present invention.

Referring to FIG. 6, a PDP according to another exemplary embodiment of the present invention has the same structure as FIG. 2, except that the light guide 231 is perpendicular to an address electrode 211.

That is, the address electrode 211, a first dielectric layer 212, a dam (not shown) and a phosphor layer 214 are disposed on a lower substrate 210. An upper substrate 230 includes the light guide 231 which is perpendicular to the address electrode 211, an external light blocking member 232 between exit surfaces 231*b* of the light guides 231, and a space 233 surrounded by the light guides 231 and the external light blocking member 232. A pair of discharge electrodes 221*a* and 221*b*, a pair of bus electrodes 222*a* and 222*b*, a second dielectric layer 223 and a protection layer 224 are disposed under the upper substrate 230.

The lower substrate 210 and the upper substrate 230 are separated from each other, so a plurality of discharge cells 215 are formed for plasma discharge. The discharge cell 215 is filled with discharge gas, which is a mixture of neon (Ne) and a small amount of Xenon (Xe). In the light guide 231, visible light generated from the discharge cell 115 is received through an incidence surface 231*a* and focused so as to exit through the exit through surface 231*b*.

As described above, as all structure and features, except for the feature that the light guide 231 is perpendicular to the address electrode 211, are the same in FIGS. 2-5B, the description is omitted.

Figure 7:
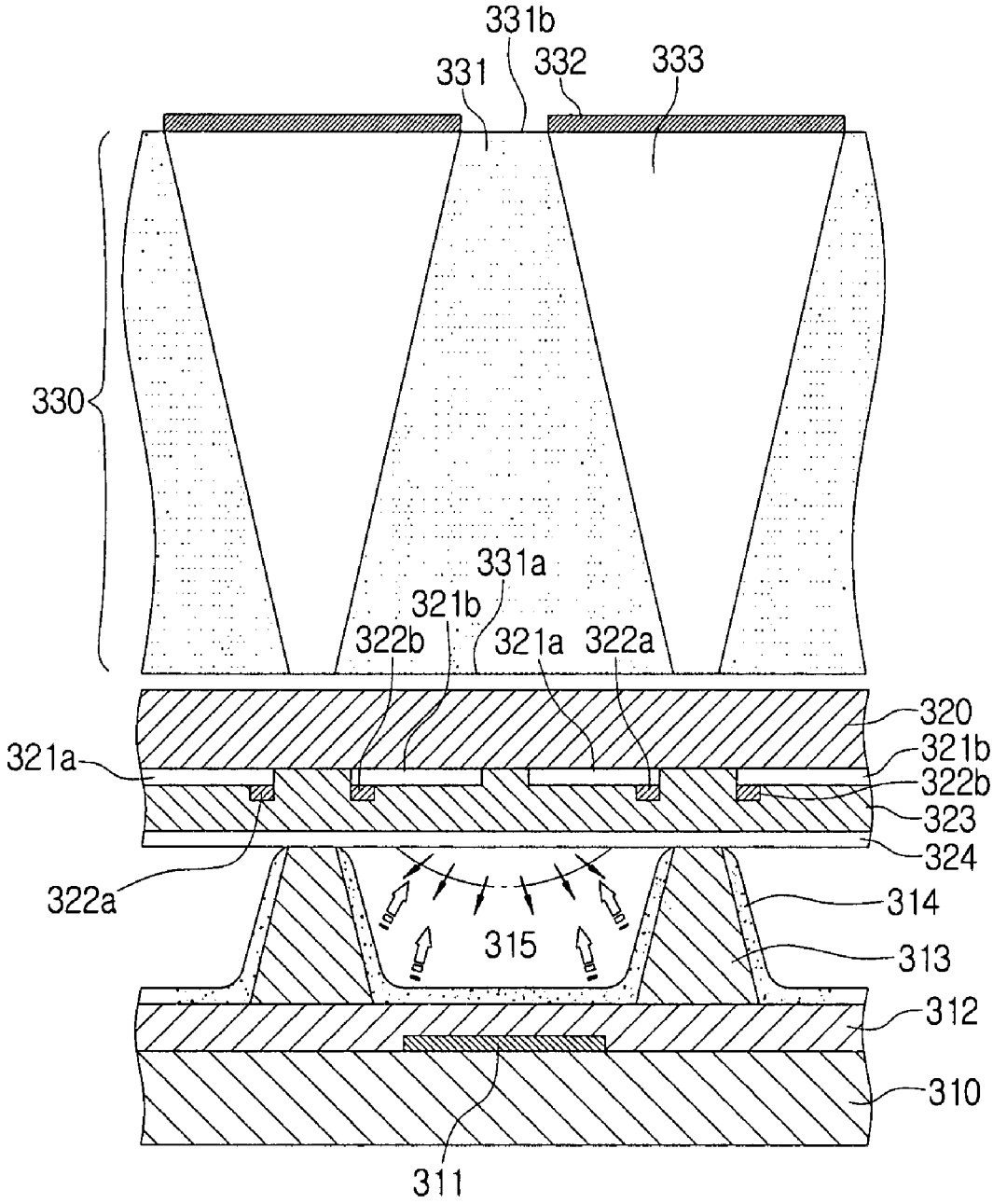
FIG. 7 shows a filter which is employed to enhance the bright room contrast of a PDP according to yet another exemplary embodiment of the present invention.

FIG. 7 shows a filter which is employed to enhance the bright room contrast of a PDP according to yet another exemplary embodiment of the present invention.

Figure 1:
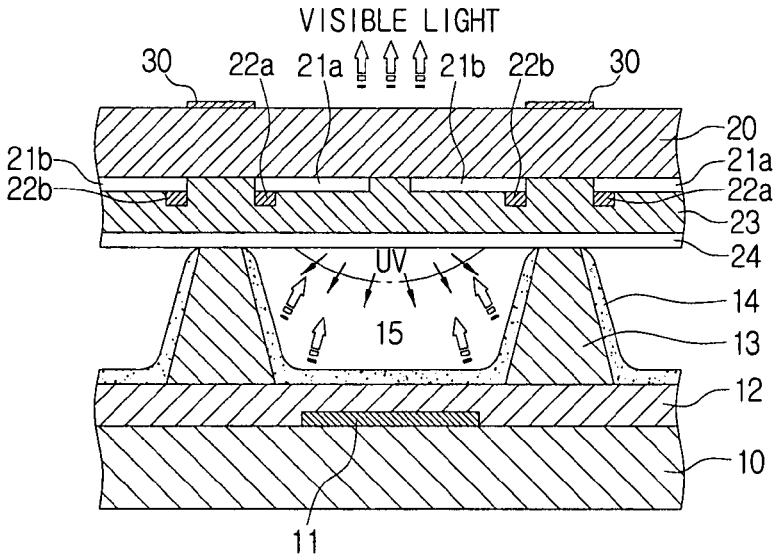
FIG. 1 (PRIOR ART)
FIG. 1 shows the structure of a conventional PDP.

The PDP of FIG. 7 has the same structure as a conventional PDP, as shown in FIG. 1, and the PDP is partially incised and has an upper substrate 320 rotated 90°.

An address electrode 311, a first dielectric layer 312, a dam 313 and a phosphor layer 314 are disposed on a lower substrate 310. A pair of sustaining electrodes 321*a* and 321*b*, a pair of bus electrodes 322*a* and 322*b*, a second dielectric layer 323 and a protection layer 324 are disposed under the upper substrate 320. The lower substrate 310 and the upper substrate 320 are separated by a predetermined space and sealed to form discharge cells 315.

A filter 330 is disposed on the upper substrate 320 to focus and emit visible light generated from the discharge cells 315. The filter 330 comprises a light guide 331 in which the incidence surface 331*a* is wider than the exit surface 331*b*, and an external light blocking member 332 between the exit surfaces 33 lb. A space 333, which is surrounded by the light guide 331 and the external light blocking member 332, is formed in the filter 330 and is filled with gases, such as air. The interface of the light guide 331 is processed not to cause light scattering.

The light guide 331 can be configured so that one light guide 331 corresponds to one discharge cell 315 as shown in FIG. 7, or can be configured so that several light guides 331 correspond to one discharge cell 315. As the light guide 331 can be produced with a width of less than a few tens of micrometers, it can be employed in a display device for high precision images. Moreover, the exit surface 331*b* of the light guide 331 is processed with a non-glare treatment, so it can prevent glare by reflecting external light from the exit surface 331*b* of the light guide 331.

As the process of forming the external light blocking member 332 included in the filter 330 of FIG. 7 is the same as that of FIG. 3, and optical features of the light guide 331 are the same as those of FIGS. 4A~5B, description of these is omitted. The filter 330 can be bonded on the upper substrate 320 in a film form.

Figure 8:
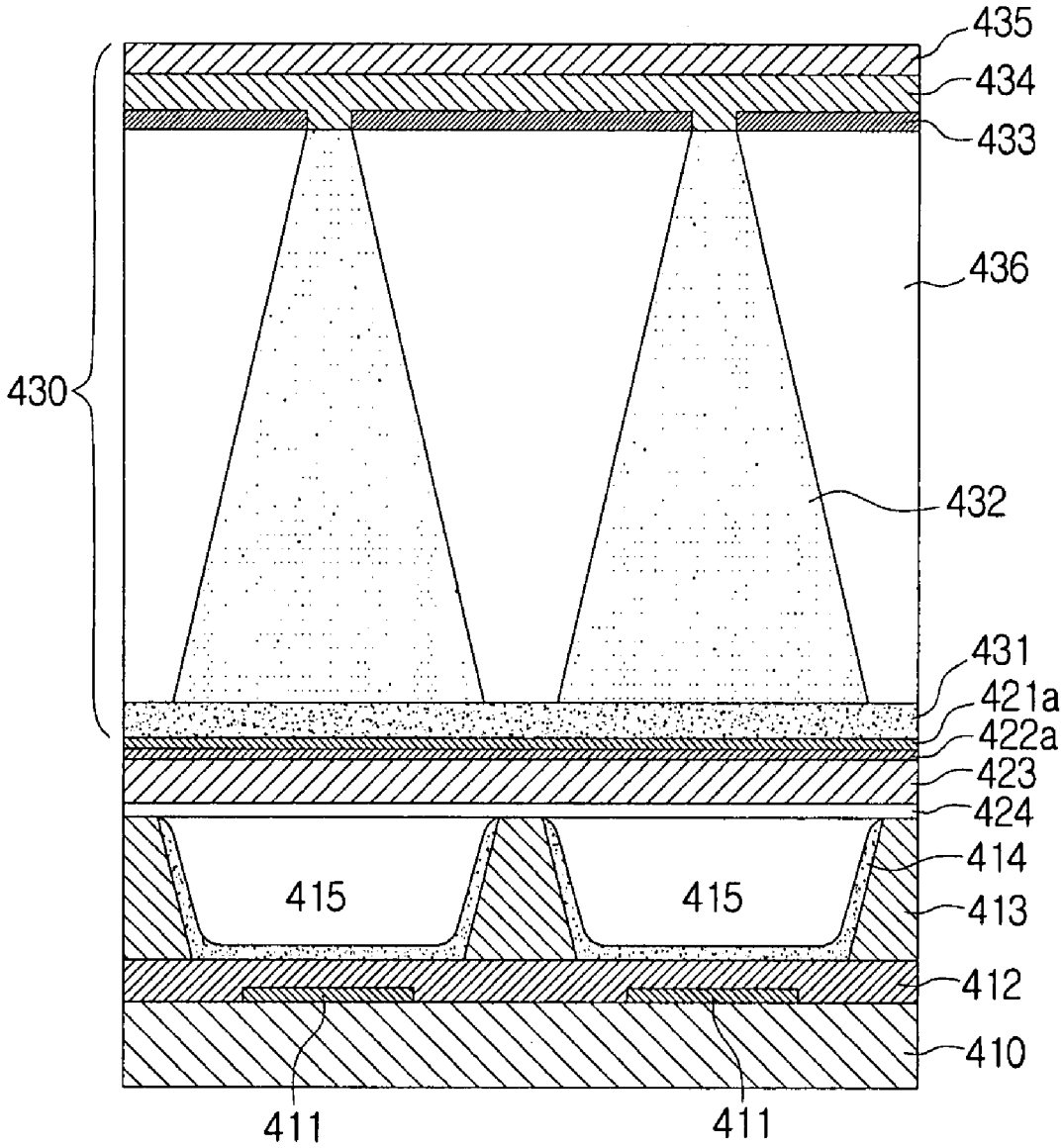
FIG. 8 shows components added to the PDP of FIG. 2.

FIG. 8 shows components added to the PDP of FIG. 2.

The PDP of FIG. 8 has the same basic structure as that of FIG. 2. That is, an address electrode 411, a first dielectric layer 412, a plurality of dams 413 and a phosphor layer 414 are disposed on a lower substrate 410. A discharge cell 415 is filled with discharge gas. Discharge electrodes 421*a* (and 421*b*, not shown), bus electrodes 422*a* (and 422*b*, not shown), a second dielectric layer 423 and a protection layer 424 are disposed under an upper substrate 430.

The upper substrate 430 comprises a near infrared blocking layer 431 which blocks near infrared rays closest to visible light among the light rays generated from the discharge cell 415, and enhances color purity. A light guide 432 is disposed on the near infrared blocking layer 431, and an external light blocking member 433 is formed between exit surfaces of the light guides 432 to block external light from entering the discharge cell 415. A space 436 is formed surrounded by the light guide 432 and the external light blocking member 433.

An electromagnetic interference (EMI) prevention layer 434, which prevents EMI, is disposed on the exit surface of the light guide 432 and the external light blocking member 433 as a mesh manner or conductive film. An antireflection layer 435 is disposed on the EMI prevention layer 434 to prevent external light from being reflected and is implemented as an anti-reflective (AR) film.

The light guides 432 can be configured so that one light guide corresponds to one discharge cell 415 as shown in FIG. 2, or can be configured so that one light guide corresponds to several discharge cells 415. In addition, the near infrared blocking layer 431, the light guide 432, the external light blocking member 433, the EMI prevention layer 434 and the antireflection layer 435 can be disposed differently.

Figure 9:
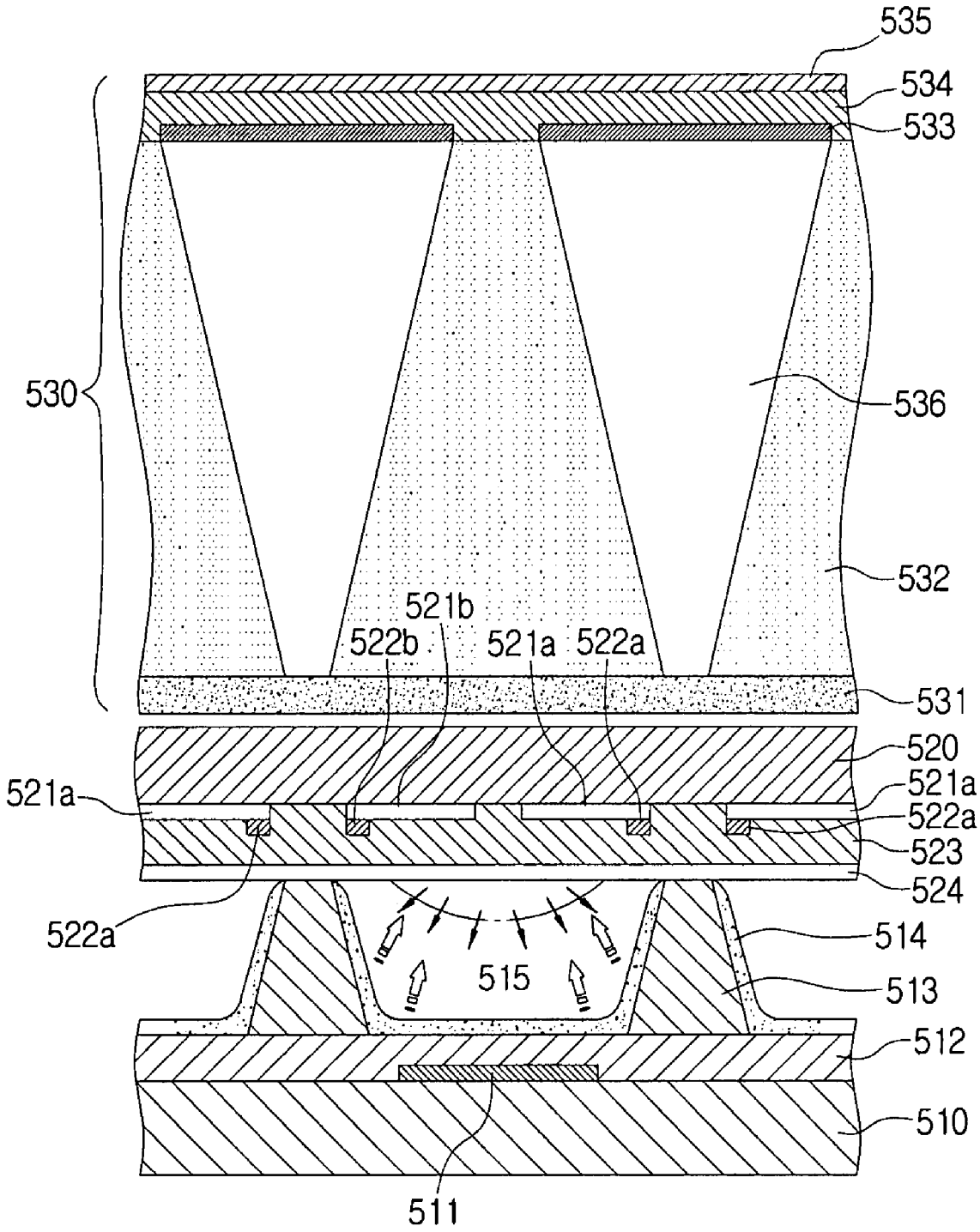
FIG. 9 shows components added to a filter which is employed to enhance the bright room contrast of the PDP of FIG. 7.

FIG. 9 shows components added to a filter which is employed to enhance the bright room contrast of the PDP of FIG. 7.

The PDP of FIG. 9 has the same structure as a conventional PDP, as shown in FIG. 1, and the PDP is partially incised and has an upper substrate 520 rotated at 90°.

An address electrode 511, a first dielectric layer 512, a dam 513 and a phosphor layer 514 are disposed on a lower substrate 510. A pair of sustaining electrodes 521*a* and 521*b*, a pair of bus electrodes 522*a* and 522*b*, a second dielectric layer 523 and a protection layer 524 are disposed under the upper substrate 520. The lower substrate 510 and the upper substrate 520 are separated by a predetermined space and sealed to form discharge cells 515.

A filter 530 is disposed on the upper substrate 520 to focus and emit visible light generated from the discharge cells 515 and to block light from the outside. The filter 530 comprises a near infrared blocking layer 531 which blocks near infrared rays closest to visible light among light rays generated by the discharge cell 515, and enhances color purity. A light guide 532 is disposed on the near infrared blocking layer 531, and an external light blocking member 533 is formed between exit surfaces of the light guides 532 to block light from the outside into the discharge cell 515. A space 536 is formed surrounded by the light guide 532 and the external light blocking member 533.

An electromagnetic interference (EMI) prevention layer 534, which prevents EMI, is disposed on the exit surface of the light guide 532 and the external light blocking member 533 as a mesh or a conductive film. An antireflection layer 535 is disposed on the EMI prevention layer 534 to prevent external light from being reflected, and is implemented as an anti-reflective (AR) film.

The light guides 532 can be configured so that one light guide 532 corresponds to one discharge cell 515 as shown in FIG. 9, or can be configured so that several light guides 532 correspond to one discharge cell 515. In addition, the near infrared blocking layer 531, the light guide 532, the external light blocking member 533, the EMI prevention layer 534 and the antireflection layer 535 can be located differently. The filter 530 may be bonded on the upper substrate 520 as a film.

The upper substrates 130, 230 and 430 of FIGS. 2, 6 and 8 and the filters 330 and 530 of FIGS. 7 and 9 can be bonded on the PDP as a film.

As described above, external light is blocked and glare is prevented by improving the structure of the upper substrate of the PDP or employing a structurally enhanced filter on the PDP. Moreover, the bright room contrast of the PDP can be enhanced by improving the capability of totally reflecting visible light generated from the discharge cell.

As aforementioned, the exemplary embodiments of the present invention are shown and described, but the present invention is not limited to the specific embodiments described above, and can be implemented in various modifications by those skilled in the art to which the present invention pertains without departing from the scope of the invention as defined by the appended claims and the full scope of equivalents thereof.

What is claimed is:

1. A display panel comprising:

a plurality of light guides having exit surfaces which emit received light; and a plurality of external light blocking members which are bonded directly on top of the exit surfaces and disposed on spaces formed between the plurality of light guides, and block light from the outside, wherein each of the spaces is filled with air.

2. The display panel of claim 1, wherein the spaces are formed under the plurality of external light blocking members.

3. The display panel of claim 1, wherein each of the external light blocking members is composed of carbon black of maximum density.

4. The display panel of claim 1, wherein each of the incident surfaces through which light enters is wider than the exit surfaces.

5. The display panel of claim 1, further comprising an electromagnetic interface (EMI) prevention layer disposed on the exit surfaces of the light guides, which prevents EMI.

6. The display panel of claim 5, wherein the EMI prevention layer is formed as a mesh or as a conductive film.

7. The display panel of claim 1, further comprising an antireflection layer, disposed externally to the light guides, which prevents external light from being reflected.

8. The display panel of claim 7, wherein the antireflection layer is formed as an anti-reflective (AR) film.

9. The display panel of claim 1, further comprising a near infrared blocking layer which blocks near infrared rays included in light rays passing through the light guide, wherein the light guides are disposed on the near infrared blocking layer.

10. A plasma display panel (PDP), comprising:

a lower substrate and an upper substrate which are separated to form a plurality of discharge cells therebetween, wherein the upper substrate comprises a plurality of light guides having exit surfaces, which focus and emit light generated from the plurality of discharge cells; and a plurality of external light blocking members which are bonded directly on top of the exit surfaces and disposed on spaces formed between the plurality of light guides, and block light from the outside, wherein each of the spaces is filled with air.

11. The PDP of claim 10, wherein the spaces are formed on the upper substrate, which are surrounded by the plurality of light guides and the plurality of external light blocking members.

12. The PDP of claim 10, wherein the external light blocking members are composed of carbon black of maximum density.

13. The PDP of claim 10, wherein each of the plurality of light guides has an incident surface through which light enters that is wider than an exit surface.

14. The PDP of claim 10, further comprising a plurality of address electrodes which are disposed on the lower substrate in a striped pattern and generate a wall charge in the discharge cells.

15. The PDP of claim 14, wherein the plurality of light guides are parallel to the plurality of address electrodes.

16. The PDP of claim 14, wherein the plurality of light guides are perpendicular to the plurality of address electrodes.

17. The PDP of claim 10, further comprising an electromagnetic interface (EMI) prevention layer, disposed on the exit surfaces of the light guides, which prevents EMI.

18. The PDP of claim 17, the EMI prevention layer is formed as a mesh or as a conductive film.

19. The PDP of claim 10, further comprising an antireflection layer, disposed externally to the light guides, which prevents external light from being reflected.

20. The PDP of claim 19, wherein the antireflection layer is formed as an anti-reflective (AR) film.

21. The PDP of claim 10, further comprising a near infrared blocking layer which blocks near infrared rays included in light rays passing through the light guide, wherein the light guides are disposed on the near infrared blocking layer.

22. A filter which filters screen output of a display device, the filter comprising:

a plurality of light guides having exit surfaces which emit received light; and a plurality of external light blocking members which are bonded directly on top of the exit surfaces and disposed on spaces formed between the plurality of light guides, and block light from the outside, wherein each of the spaces is filled with air.

23. The filter of claim 22, wherein the spaces are formed under the plurality of external light blocking members.

24. The filter of claim 22, wherein the external light blocking members are composed of carbon black of maximum density.

25. The filter of claim 22, wherein each of the light guides has an incident surface through which light enters that is wider than an exit surface.

26. The filter of claim 22, wherein the display device is a PDP.

27. The filter of claim 22, further comprising an electromagnetic interface (EMI) prevention layer disposed on the exit surfaces of the light guides, which prevents EMI.

28. The filter of claim 27, wherein the EMI prevention layer is formed as a mesh or as a conductive film.

29. The filter of claim 22, further comprising an antireflection layer disposed externally to the light guides, which prevents external light from being reflected.

30. The filter of claim 29, wherein the antireflection layer is formed as an anti-reflective (AR) film.

31. The filter of claim 22, further comprising a near infrared blocking layer which blocks near infrared rays included in light rays passing through the light guides, wherein the light guides are disposed on the near infrared blocking layer.

32. A filter, comprising:

a plurality of light guides having exit surfaces, which are bonded on a display panel, and focus and emit light generated from the display panel; and a plurality of external light blocking members which are bonded directly on top of the exit surfaces and disposed on air layers formed between the plurality of light guides, and block light from the outside, wherein each of the spaces is filled with air.

33. The display panel of claim 1, wherein the plurality of external light blocking members and the exit surfaces are disposed at different heights with respect to each other.

34. The PDP of claim 10, wherein the plurality of external light blocking members and the exit surfaces are disposed at different heights with respect to each other.

35. The filter of claim 22, wherein the plurality of external light blocking members and the exit surfaces are disposed at different heights with respect to each other.

36. The filter of claim 32, wherein the plurality of external light blocking members and the exit surfaces are disposed at different heights with respect to each other.

* * * * *